US012352005B2

(12) United States Patent
Schauer

(10) Patent No.: US 12,352,005 B2
(45) Date of Patent: Jul. 8, 2025

(54) QUICK-CHANGE SYSTEM FOR CHANGING ATTACHMENTS ON A CONSTRUCTION MACHINE

(71) Applicant: OilQuick Deutschland KG, Steindorf (DE)

(72) Inventor: Stefan Schauer, Kissing (DE)

(73) Assignee: OilQuick Deutschland KG, Steindorf (DE)

( * ) Notice: Subject to any disclaimer, the term of this patent is extended or adjusted under 35 U.S.C. 154(b) by 797 days.

(21) Appl. No.: 17/376,783

(22) Filed: Jul. 15, 2021

(65) Prior Publication Data

US 2022/0018090 A1 Jan. 20, 2022

(30) Foreign Application Priority Data

Jul. 17, 2020 (DE) ..... 10 2020 118 938.9

(51) Int. Cl.
*E02F 3/36* (2006.01)

(52) U.S. Cl.
CPC ..... *E02F 3/3681* (2013.01); *E02F 3/3663* (2013.01); *E02F 3/3677* (2013.01)

(58) Field of Classification Search
CPC ..... E02F 3/3681; E02F 3/3663; E02F 3/3627; E02F 3/3636; E02F 3/3677
See application file for complete search history.

(56) References Cited

U.S. PATENT DOCUMENTS

| | | | | |
|---|---|---|---|---|
| 4,333,676 A * | 6/1982 | Thumm | E02F 3/3681 294/68.23 |
| 9,562,346 B2 * | 2/2017 | Jonsson | E02F 9/24 |
| 10,214,874 B2 * | 2/2019 | Harr | E02F 3/3681 |
| 2016/0251835 A1 * | 9/2016 | Kitajima | E02F 3/3663 701/50 |

FOREIGN PATENT DOCUMENTS

| | | | | |
|---|---|---|---|---|
| DE | 102010027895 A1 * | 10/2011 | E02F 3/3681 |
| DE | 202011100482 U1 * | 10/2012 | E02F 3/3627 |
| DE | 102013206574 A1 * | 10/2014 | E02F 3/3681 |
| JP | H07150586 A * | 6/1995 | |
| JP | 2002266368 A * | 9/2002 | |
| SE | 1351174 A1 * | 4/2015 | |
| WO | WO-2015155627 A1 * | 10/2015 | B66C 3/005 |

OTHER PUBLICATIONS

Result of Examination Report for German Patent application No. 10 2020 118 939.9 filed Jul. 17, 2020.
Office Action dated Aug. 6, 2024 from Japanese Patent Application No. 2021-072465.

* cited by examiner

*Primary Examiner* — Christopher J Sebesta
*Assistant Examiner* — Blake E Scoville
(74) *Attorney, Agent, or Firm* — Fleit Intellectual Property Law; Paul D. Bianco; Katharine Davis Wong

(57) ABSTRACT

A quick-change system for changing attachments on a construction machine includes a quick changer mounted to rotate in a drive housing of a rotary device and rotatable relative to drive housing by a rotary drive, and a rotary joint arranged in the drive housing with a stator and a rotor rotatable within stator to supply a working fluid to the quick changer. In order to permit simple and stable fastening of the rotary joint, the stator of the rotary joint arranged within a through-opening of the drive housing is radially supported against the drive housing above an upper end surface and beneath the upper end surface of a drive wheel of the rotary drive arranged in the drive housing.

10 Claims, 2 Drawing Sheets

QUICK-CHANGE SYSTEM FOR CHANGING ATTACHMENTS ON A CONSTRUCTION MACHINE

FIELD OF THE DISCLOSURE

The disclosure relates to a quick-change system for changing attachments on a construction machine.

BACKGROUND

This type of quick-change system is known from DE 10 2013 206 574 A1 for simple and convenient changing of various attachments on construction machines. It has a quick changer mounted to rotate in a drive housing and rotatable by a rotary drive relative to the drive housing and a rotary joint arranged in the drive housing with a stator and a rotor rotatable within the stator to supply working fluid to the quick changer. The attachments connected to the quick changer, such as tilting buckets, double-scoop buckets, shears, compactors, magnets, hydraulic hammers, or the like, can be connected by the rotary drive not only around a pivot axis arranged transverse to the longitudinal axis of an excavator arm, but also around an axis of rotation orthogonal to said pivot axis. A fluid connection between the drive housing and the rotatable quick changer is made possible via the rotary joint to supply the quick changer with a working fluid.

The rotary joint in such quick-change systems ordinarily has a stator designed as a stationary outer cylinder and a rotor mounted to rotate in the stator. The stator is generally fastened onto a cover plate of the drive housing via a flange or another appropriate mount and a number of screws and protrudes relatively far downward without radial support. Vibrations can occur through impacts or shock loads during use of the quick-change system and thereby damage the rotary joint and connection parts.

SUMMARY

One aspect of the disclosure relates to a quick-change system that permits simple and stable fastening of the rotary joint.

Accordingly, a quick-change system is disclosed herein. Expedient embodiments and advantageous refinements are also disclosed herein.

The stator of the rotary joint arranged within a through-opening of the drive housing in the quick-change system according to the disclosure is radially supported against the drive housing above an upper end surface and below the upper end surface of a drive wheel of the rotary drive arranged in the drive housing. Because of this the stator is guided on a relatively large length radially relative to the drive housing of the rotary joint so that a particularly stable arrangement of the rotary joint within the drive housing protected against tilting movements or vibrations is made possible. Through the configuration and arrangement of the rotary joint, the design space available in the drive housing can also be optimally exploited so that even a higher number of supply channels with larger flow rates is permitted. Supply of several loads even with possibly higher requirement for hydraulic fluid can therefore also be guaranteed. Higher volumetric flow rates of a working fluid at lower back pressures can thereby also be transferred via the rotary joint. Owing to the good radial support of the rotary joint within the housing, fastening of the rotary joint can also be simplified and assembly facilitated.

In a particularly expedient embodiment, the stator of the rotary joint is supported radially by a bearing ring of the drive housing that bounds the through-opening. The bearing ring of the drive housing serves not only for rotatable support of the drive wheel, but also for radial support of the rotary joint and offers a large support surface for radial support of the stator. The drive wheel for rotation of the quick changer is expediently mounted to rotate on the outside of the bearing ring that also supports the stator.

Particularly good radial support for the stator of the rotary joint can be achieved by the largest possible surface on the inside of the bearing ring. A lower end of the bearing ring can expediently be arranged in the area of a lower side of the drive wheel.

In a further advantageous manner, the stator of the rotary joint is arranged radially sealed in the through-opening of the drive housing via at least one sealing element. This can prevent oil or dirt from getting between the drive housing and the stator. Entry of oil or dirt from the upper to the lower part or from the lower to the upper part of the drive housing can thus be avoided. Troubleshooting during service can also thereby be facilitated due to the clear separation. Damped guidance and securing of the rotary joint within the drive housing is also attainable. Because of its arrangement and design integrated in the drive housing, the rotary joint can preferably have more than seven supply channels to supply a working fluid to the quick changer. Attachments with several connections can therefore also be supplied. By connecting or merging several supply channels even high-volume supply lines can be created to achieve higher flow rates at low back pressures.

According to another advantageous embodiment, the drive housing of the rotary joint can be arranged on the connection part so as to be pivotable about the pivot axis orthogonal to the axis of rotation. The attachments connected to the quick changer can then be not only rotated about the axis of rotation, but also tilted relative to the connection part around the pivot axis orthogonal to the axis of rotation, thereby expanding the movement capabilities and increasing the area of application. The drive housing, however, can also be arranged fixed on the connection part without additional pivot capability so that the quick changer is rotatable relative to the connection part only about the axis of rotation.

BRIEF DESCRIPTION OF THE DRAWINGS

Additional details and advantages of the disclosed quick-change system with a quick changer are apparent from the following description of a preferred embodiment example with reference to the drawing. In the drawings.

DETAILED DESCRIPTION

Figure 1:
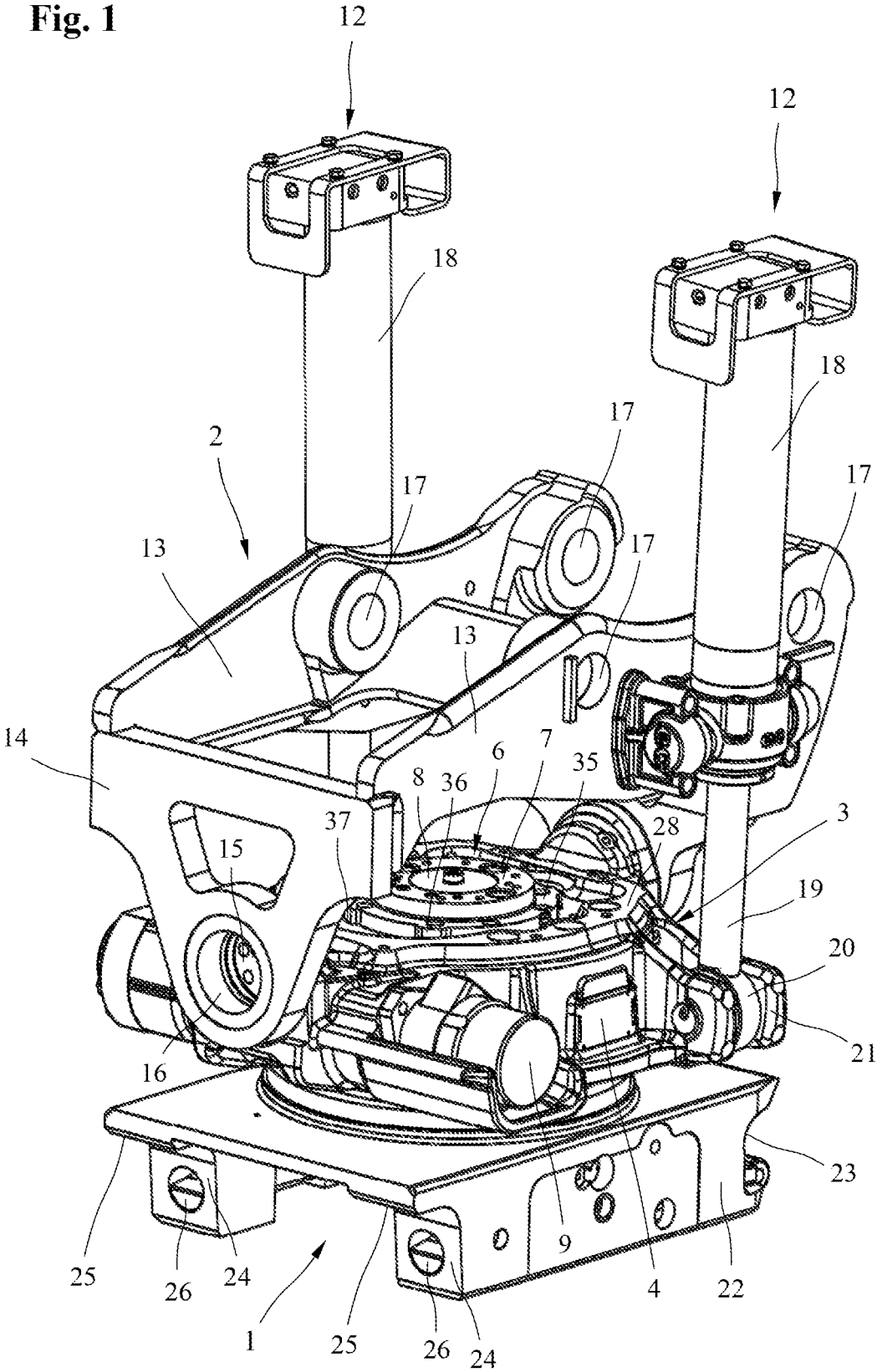
FIG. 1 shows a quick-change system with a quick changer, a connection part and a rotary device in a perspective view
Figure 2:
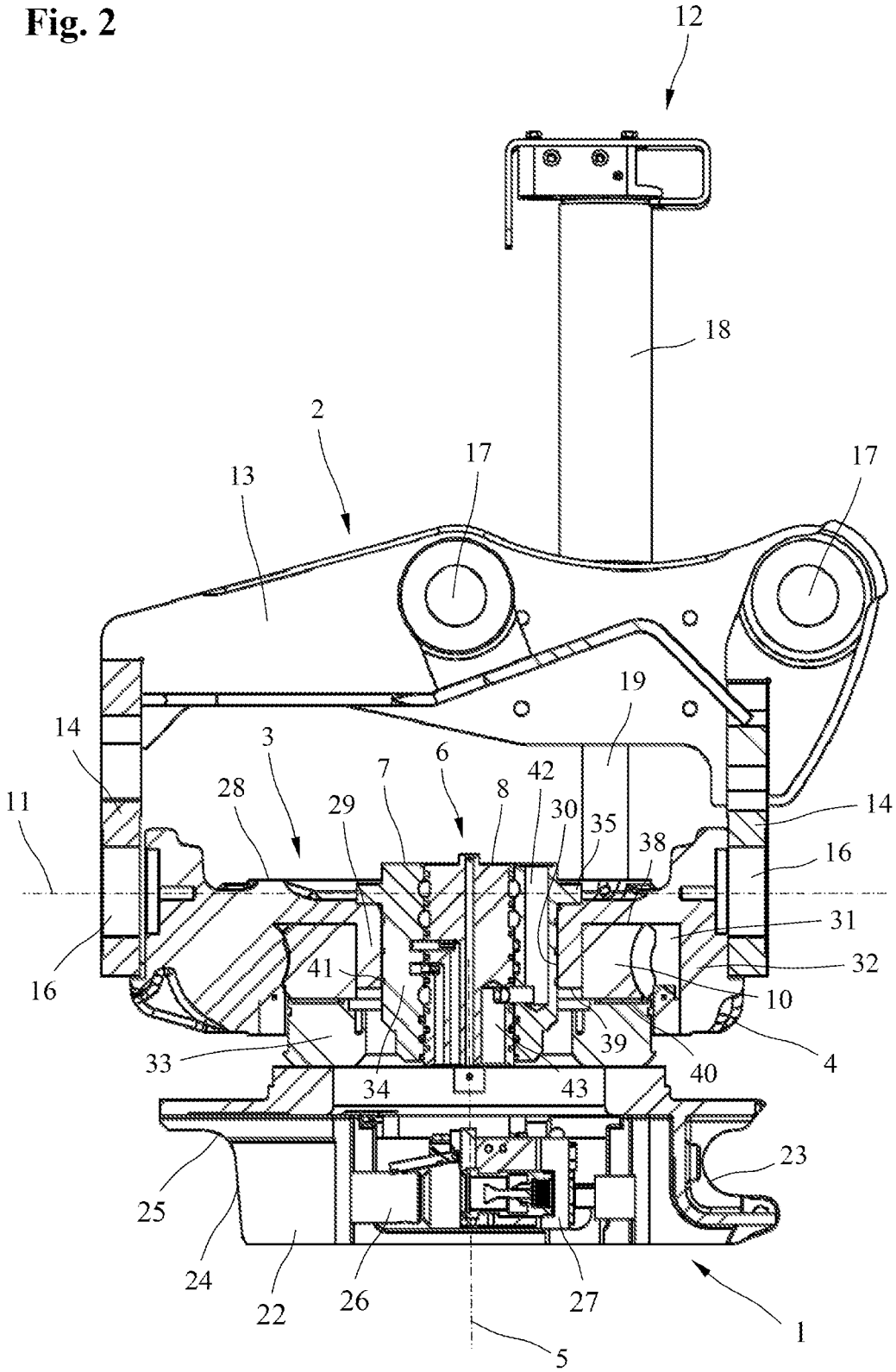
FIG. 2 shows the quick-change system of FIG. 1 in a partial section.

FIGS. 1 and 2 show an embodiment example of a quick-change system with a quick changer 1 for automatic connection of an attachment, a connection part 2 for mounting of the quick changer 1 on an excavator arm or another attachment of a construction machine, and a rotary device 3 arranged between the quick changer 1 and the connection part 2 to rotate the quick changer 1 relative to the connection part 2. The rotary device 3 contains a drive housing 4, in which the quick changer 1 is mounted to rotate around an axis of rotation 5 depicted in FIG. 2 (aligned vertically here). A rotary joint 6 with a stator 7 arranged in the drive housing 4 non-rotating relative to it and a rotor 8 rotatable within the stator to supply a working fluid to the quick changer 1 is also arranged in the drive housing 4 of the rotary device 3. Through such a rotary drive with a drive motor 9 depicted in FIG. 1 and a drive wheel 10 apparent in FIG. 2, designed here as a worm gear, the quick changer 1 can be rotated 360° about axis of rotation 5 by the motor via a worm drive (not shown) relative to the drive housing 4.

In the depicted embodiment, the drive housing 4 of the rotary device 3 is arranged on the connection part 2 so as to be pivotable about a pivot axis 11 orthogonal to the axis of rotation 5 and pivotable relative to connection part 2 about pivot axis 11 via a pivot drive formed here by two operating cylinders 12. The pivot drive for tilting the drive housing 4 relative to the connection part 2, however, can also be designed as a pivot motor or the like. Through such a quick-change system (also referred to as a tilt rotator) the attachments connected to the quick changer 1 can be not only rotated about the axis of rotation 5, but also tilted about the pivot axis orthogonal to axis of rotation 5 relative to connection part 2 so that the movement capabilities are expanded, and the applications extended. The drive housing 4, however, can also be arranged fixed on the connection part 2 without additional pivot capability so that the quick changer 1 is only rotatable about axis of rotation 5 relative to connection part 2.

The connection part 2 in the depicted embodiment example has two parallel side walls 13 as well as front and rear crosspieces 14. The drive housing 4 is mounted to pivot via bearing pins 15 apparent in FIG. 1 in corresponding bearing holes 16 of the front and rear crosspieces 14 around pivot axis 11. The connection part 2 can be mounted on an arm and coupling of an excavator via holes 17 in the two side walls 13. The two operating cylinders 12 contain a cylinder housing 18 fastened to the corresponding side wall 13 of the connection part 2 and a piston rod 19 hydraulically movable and arranged displaceable in cylinder housing 18, whose free end is connected to the drive housing 4 via an articulated rod end 20 and a corresponding mount 21. By corresponding retraction and extension of the two piston rods 19 the drive housing 4 can be tilted relative to connection part 2.

The quick changer 1 depicted in FIG. 2 in section contains a support 22 designed as a welded structure or cast part, which has first receptacles 23 open to one side to accommodate and secure a first pin-like coupling element on one side and second receptacles 24 open downward to the other side to accommodate and secure a second pin-like coupling element on the other side.

In the depicted embodiment example, the quick changer 1 has two receptacles 23 spaced apart from each other on one side of support 22 for a front coupling element and two receptacles 24 on the other side for a rear coupling element. The first receptacles 23 open to one side are claw-shaped or fork-shaped. The second receptacles 24 open downward to the other side have a curved lower support surface 25 to support a pin-like coupling element. A locking device with two pin-like locking elements 26 movable between an extended locking position and a retracted unlocking position is provided on the second receptacles 24. The two pin-like locking elements 26 are movable within support 22 and can be moved by a cylinder 27 apparent in FIG. 2 between a retracted unlocking position to release or connect an adapter or attachment and an extended locking position depicted in FIG. 1. In the extended locking position, the downward open second receptacles 24 are closed by the locking elements 26 arranged movable in guide holes in support 22 on the bottom, so that the coupling element is engaged from below by the pin-like locking elements 26.

In order to connect an attachment by means of quick changer 1, the quick changer 1 arranged via the connection part 2 generally on an excavator arm and a coupler of an excavator is initially moved so that a front pin-like coupling element arranged on an adaptor or directly on the attachment is retracted into the claw-like or fork-like receptacles 23 on one side of the quick changer 1. The quick changer 1 with the still withdrawn locking elements 26 is then pivoted about the front pin-like coupling element so that the rear coupling element on the adaptor or attachment comes into contact with the support surfaces 25 of the downward open receptacles 24 on the other side of the quick changer 1. The locking elements 26 arranged movable in the guide holes in support 22 of quick changer 1 can then be hydraulically extended so that the rear pin-like coupling element is engaged by the two locking elements 26 on the quick changer 1 and the attachment therefore held on the quick changer 1.

As follows from FIG. 2, the drive housing 4 consisting of one part has an upper annular cover surface 28, a central through-opening 30 bounded by an inner bearing ring 29 of the drive housing 4 and a downward open annular space 31 arranged around bearing ring 29 to accommodate the drive wheel 10. The annular space 31 is bounded between the outside of the inner bearing ring 29 and an inside of an outer peripheral wall 32 of the drive housing 4. The drive wheel 10 is mounted to rotate axially secured on the outside of the inner bearing ring 29 of drive housing 4 extending over almost the entire height of drive wheel 10 and serves not only for driving but also for rotatable supporting the quick changer 1 within drive housing 4. For this purpose, the support 22 of the quick changer 1 is connected firmly via an intermediate ring 33 to the axially secured drive wheel 10 mounted to rotate on the bearing ring 29 of the drive housing 4. The intermediate ring 33 can be welded fixed to support 22 and firmly joined via screws to the drive wheel 10.

The stator 7 has a hollow cylindrical base element 34 and an annular upper mounting flange 35 with outer shoulders 36 depicted in FIG. 1 for positive-locking engagement in corresponding recesses 37 on the upper cover surface 28 of the drive housing 4. The stator 7 is held in drive housing 4 restrained against rotation via the shoulders 36 on the mounting flange 35 and the corresponding recesses 37 on the upper cover surface 28 of the drive housing 4. The outside diameter of the hollow cylindrical base element 34 is adapted to the inside diameter of the through-opening 28 in drive housing 4 so that stator 7 is radially supported against the drive housing 4. Radial support of stator 7 against drive housing 4 occurs not only in the upper area of the base element 34, but also beneath an upper end surface 38 of the drive wheel, so that the stator 7 is radially supported against the drive housing 4 over a large part of its length.

As is apparent from FIG. 2, the bearing ring 29 extends relatively far downward within drive housing 4. In the depicted embodiment, a lower end 39 of bearing ring 29 is arranged in an area of a lower face side 40 of drive wheel 10. The stator 7 of the rotary joint 6 completely fills the through-opening 30 in bearing ring 29 so that a closed design is obtained. Sealing elements 41 designed here as annular seals with O-shaped or rectangular cross section are arranged between the hollow cylindrical base element 34 of the stator 7 and the drive housing 4. In the depicted embodiment, the stator 7 of the rotary joint 6 is arranged radially sealed in the through-opening 30 of the drive housing 4 via three sealing elements 41 spaced axially apart from each other. The rotary joint 6 has several supply channels in known fashion with first channel sections 42 arranged in stator 7 and second channel sections 43 in rotor 8 connected to them.

LIST OF REFERENCE NUMBERS

1 Quick changer
2 Connection part
3 Rotary device
4 Drive housing
5 Axis of rotation
6 Rotary joint
7 Stator
8 Rotor
9 Drive motor
10 Drive wheel
11 Pivot axis
12 Operating cylinder
13 Side wall
14 Crosspiece
15 Bearing pin
16 Bearing hole
17 Hole
18 Cylinder housing
19 Piston rod
20 Articulated rod end
21 Mount
22 Support
23 First receptacle
24 Second receptacle
25 Support surface
26 Locking element
27 Cylinder
28 Cover surface
29 Bearing ring
30 Through-opening
31 Annular space
32 Peripheral wall
33 Intermediate ring
34 Base element
35 Mounting flange
36 Shoulder
37 Recess
38 Upper end surface
39 Lower end of bearing ring
40 Lower face side
41 Sealing element
42 First channel section
43 Second channel section

What is claimed is:

1. A quick-change system for changing attachments on a construction machine, the quick-change system comprising:

a quick changer mounted to rotate in a drive housing of a rotary device and rotatable relative to the drive housing by a rotary drive, the quick changer including a support having first receptacles to accommodate a first coupling element, second receptacles to accommodate a second coupling element, and a locking device assigned to the second receptacles, the locking device having at least one locking element movable between an unlocking position and a locking position; and a rotary joint arranged in the drive housing having a stator and rotor rotatable within the stator to supply a working fluid to the quick changer, wherein the stator of the rotary joint is arranged within a through-opening of the drive housing and radially supported by an inner bearing ring of the drive housing, a surface of the inner bearing ring extending over a height of a drive wheel of the rotary drive such that the stator is continuously radially supported against the drive housing from above an upper end surface of the drive wheel to beneath the upper end surface of the drive wheel by the surface of the inner bearing ring, and wherein the stator of the rotary joint includes a hollow cylindrical base element and an annular upper mounting flange having outer shoulders configured for positive-locking engagement in corresponding recesses on an upper cover surface of the drive housing.

2. The quick-change system according to claim 1, wherein the drive wheel is mounted to rotate on an outside of the inner bearing ring of the drive housing.

3. The quick-change system according to claim 1, wherein a lower end of the inner bearing ring is arranged in a region of a lower face side of the drive wheel.

4. The quick-change system according to claim 1, wherein the stator of the rotary joint is arranged radially sealed in the through-opening of the drive housing via at least one sealing element.

5. The quick-change system according to claim 1, wherein the rotary joint has at least seven supply channels with first channel sections arranged in the stator and with second channel sections arranged in the rotor connected to them.

6. The quick-change system according to claim 1, wherein the drive housing includes a downward open annular space arranged around the inner bearing ring to accommodate the drive wheel.

7. The quick-change system according to claim 6, wherein the downward open annular spaced is bounded between an outside of the inner bearing ring and an inside of an outer peripheral wall of the drive housing.

8. The quick-change system according to claim 1, wherein the drive housing of the rotary device is arranged pivotable on a connection part about a pivot axis orthogonal to an axis of rotation.

9. The quick-change system according to claim 1, wherein the stator, the hollow cylindrical base element, and the annular upper mounting flange are formed as one piece.

10. The quick-change system according to claim 1, wherein the positive-locking engagement of the outer shoulders with the corresponding recesses holds the stator in the drive housing restrained against rotation.

* * * * *